US006175341B1

(12) United States Patent
Noir et al.

(10) Patent No.: US 6,175,341 B1
(45) Date of Patent: Jan. 16, 2001

(54) ELASTICALLY DEFORMABLE ANTENNA REFLECTOR FOR A SPACECRAFT

(75) Inventors: Alain Noir, Courbevoie; Christophe Prud'hon, Rueil Malmaison; Noël Antoine, Mantes la Jolie; Guillaume Cautru, Poses, all of (FR)

(73) Assignee: Aerospatiale Societe Nationale Industrielle, Paris (FR)

( * ) Notice: Under 35 U.S.C. 154(b), the term of this patent shall be extended for 0 days.

(21) Appl. No.: 09/283,986

(22) Filed: Apr. 2, 1999

(30) Foreign Application Priority Data

Apr. 3, 1998 (FR) ..... 98 04149

(51) Int. Cl.[7] ..... H01Q 15/20
(52) U.S. Cl. ..... 343/915; 343/705
(58) Field of Search ..... 343/705, 708, 343/912, 915; 244/160

(56) References Cited

U.S. PATENT DOCUMENTS

| | | | | |
|---|---|---|---|---|
| 3,176,303 | | 3/1965 | Holland | 343/915 |
| 3,618,101 | | 11/1971 | Franz et al. | 343/705 |
| 4,133,501 | | 1/1979 | Pentlicki | 244/173 |
| 4,231,537 | * | 11/1980 | Lyons | 244/160 |
| 4,529,277 | * | 7/1985 | Gee et al. | 343/915 |
| 4,780,726 | * | 10/1988 | Archer et al. | 343/915 |
| 4,926,181 | * | 5/1990 | Stumm | 343/915 |
| 5,574,472 | | 11/1996 | Robinson | 343/915 |

FOREIGN PATENT DOCUMENTS

| | | |
|---|---|---|
| 0293877 | 12/1988 | (EP) . |
| 0749177 | 12/1996 | (EP) . |
| 2526986 | 11/1983 | (FR) . |

* cited by examiner

*Primary Examiner*—Tan Ho
(74) *Attorney, Agent, or Firm*—Stevens, Davis, Miller & Mosher, L.L.P.

(57) ABSTRACT

An antenna reflector for a spacecraft is elastically deformable so as to be capable of changing from a folded position, when inside the spacecraft, to a deployed position, outside the spacecraft, at least partly under the action of its own elasticity. The reflector is separated into at least two parts by first opposing slot edges forming a crossing slot, so that in the folded position, the first opposing edges move with respect to each other so as to allow a protruding peripheral part of the reflector to be arranged closer to a longitudinal end of the spacecraft with damaging any portion of the reflector. In one embodiment, the two parts may be further separated by a radial slot which is arranged substantially orthogonal to the crossing slot.

15 Claims, 7 Drawing Sheets

ELASTICALLY DEFORMABLE ANTENNA REFLECTOR FOR A SPACECRAFT

BACKGROUND OF THE INVENTION

1. Field of the Invention

The present invention relates to an elastically deformable antenna reflector for a spacecraft, such as an artificial satellite or space probe.

2. Description of the Related Art

It is known that the items of equipment, such as the antenna, solar panels, etc, associated with a spacecraft have to be able to be folded in order to be able to be accommodated in a launch vehicle (rocket, shuttle) and to be deployed after ejection out of said launch vehicle, so as to take up their operational configuration.

It is known, moreover, that such equipment has already been produced in such a way that it is elastically deformable, this equipment then being able to take up either a deployed state, or a folded state, elastically deformed. By way of example, mention may be made of:

- the U.S. Pat. No. 3,521,290, which describes an antenna reflector in a single piece of an elastically deformable material provided with a rigid central base to which are linked a plurality of radial ribs integral with the convex face of said reflector and elastically articulated to said central base. Thus, said antenna reflector can take up a position folded into the shape of a tulip, which does not risk entailing a permanent deformation of said reflector, and the change from the folded position into the deployed position in the shape of a concave disk can be carried out under the action of the elastic energy stored during the folding of the antenna structure. Controllable retaining means, consisting of a belt with pyrotechnic bolts surrounding said folded reflector and arranged on the opposite side from said central base, are provided in order to hold said reflector and said radial ribs in the folded position under stress;
- the U.S. Pat. No. 4,133,501, which describes a solar panel in a single piece for a spacecraft produced in an elastically deformable way in order to take up either a curved folded position under stress in which said solar panel matches the convex outer surface of said spacecraft, or a flat deployed position, clear of said outer surface, the change from the curved, folded position to the flat, deployed position being due to the elastic relaxation of said solar panel. In the curved folded position, the solar panel is held against the outer surface of said spacecraft by latches, carried by the spacecraft; and
- the U.S. Pat. No. 4,926,181, which describes an antenna reflector in a single piece of an elastically deformable material, which can be rolled into a cylindrical shape and held in this shape by clamps. An underlying pliable structure can be deployed, in order to serve as a support on which said reflector can unroll and take up its deployed, operating shape, under the action of its elastic relaxation.

Moreover, as demonstrated, for example, by the U.S. Pat. No. 5,644,322, it is usual, for launching said spacecraft, to store it in an elongate casing, for example of cylindrical-conical shape, constituting, for example, the upper nose cone of the launch rocket, the reflector of the antenna or antennae of said spacecraft being arranged laterally with respect to the body of the latter in the peripheral space defined between said body and said casing. In this prior document, the antenna reflector consists of a central rigid base of large surface area surrounded by a peripheral frustoconical ring produced from an elastically deformable material. Hence, by virtue of such a structure, the size of the reflector, within said cylindrical-conical casing, can be slightly reduced by temporarily elastically deforming said peripheral ring, said reflector then taking up the shape, at least approximately, of a bowl laterally encasing said body. The reflector is kept in this bowl shape by a belt, loosening of which is controlled electrically and which surrounds said body and said reflector at the center of said base, this belt folding said elastically deformable ring down onto said body, bearing on two diametrally opposite points of said ring. After ejection in space, said reflector can resume its operating position, by removal of said belt and elastic return of said peripheral ring to its elastically relaxed, stable, deployed position.

It can easily be understood that, in such a device, the saving in size of said reflector in the folded position, by comparison with the deployed position, is limited. This is because, on the one hand, because of the large diameter of said rigid central base, the lateral compression of the reflector can be applied only to the peripheral ring, such that the saving in the lateral size is relatively small. Moreover, this lateral compression not only exerts no reducing action on the longitudinal dimension of said reflector, but also increases said dimension due to the fact that it entails the straightening of the upper part of said peripheral ring outwards. The longitudinal size of the reflector, in the folded position, is thus greater than that of its deployed position. Because of its dimensions, said reflector generally overshoots the upper longitudinal end of the body of said vehicle housed in the cylindrical part of the casing and has to be extended into the conical part thereof. This conical shape thus imposes a limitation on the diameter of the reflector. However, for obvious reasons of performance, it would be advantageous for the reflector to be able to have as large a diameter as necessary, and to match the convergent shape of the conical part of the casing.

Moreover, it will be noted that, in the folded position, the reflector of the U.S. Pat. No. 5,644,322 is not held firmly, such that it is subject to the vibrations induced during the launch. This can result in difficulties of dynamic balancing and of damping of the vibration of said reflector, and even damage to the reflector or to the surrounding objects.

SUMMARY OF THE INVENTION

The object of the present invention is to remedy these drawbacks, while making it possible to increase the dimensions of said antenna reflector.

To this end, according to the invention, the antenna reflector for a spacecraft having to be stored in a casing of cylindrical-conical shape that is elongate along an axis, in such a way that said reflector is arranged laterally with respect to the body of said spacecraft, in the peripheral space defined between said body and the cylindrical part of said casing, and that said reflector exhibits a peripheral part projecting longitudinally into the conical part of said casing from the longitudinal end of said body, said reflector being at least partly elastically deformable in such a way that:

- outside said casing, said reflector can take up a stable, deployed state without elastic stress, corresponding to its functional shape;
- within said casing, said reflector, by elastic folding around said axis of the casing, can take up a folded state allowing it laterally to envelop said body, said reflector being held in this folded state by virtue of controllable retaining means; and the change by said reflector from its folded state to its deployed state being due at least in part to the release of the energy stored in said reflector when it was elastically folded in order to make it change from its deployed state to its folded state, is noteworthy:

in that said reflector is separated into two parts by opposing slot edges; and in that, in the folded position of said reflector, said opposing edges of said reflector parts move with respect to one another so as to bring said protruding peripheral part of the reflector closer to said longitudinal end of said body.

Moreover, in accordance with another important feature of the present invention, provision is made for said controllable retaining means, in the folded position of the reflector, to secure said reflector parts to the body of said spacecraft.

It is thus easily seen that, according to the present invention, the abovementioned problems of longitudinal size and of vibration are solved.

The arrangement of said the slot edges with respect to the reflector can be varied, provided that it allows the relative movement of said edges entailing the bringing of the protruding peripheral part of the reflector closer to the longitudinal end of the body of the spacecraft.

However, two particular arrangements, capable, moreover, of being taken in combination, are especially advantageous.

According to the first arrangement, said opposing slot edges delimit a slot crossing said reflector from one edge to the other, the general direction of said slot being at least approximately orthogonal to said axis of the casing. Said reflector parts may be linked to one another near the middle of said slot and said opposing edges of said reflector parts may overlap so as to bring said protruding peripheral part of the reflector closer to said longitudinal end of said body. Said slot may be diametral, such that said reflector parts each consist of a half of said reflector, said reflector halves being integral with one another near the center of said reflector. In a variant, said slot may be off-center with respect to said reflector, such that said reflector parts are unequal, said reflector parts being linked to one another by means of an articulation. According to yet another variant, said reflector parts are linked to one another near the periphery of said reflector, for example by articulations (ball joints, pin joints, elastic parts, etc) arranged at the ends of said slot, and said opposing edges of said reflector parts move apart from one another in order to bring said protruding peripheral part of the reflector closer to said longitudinal end of said body. Here again, the reflector parts bounded by said slot may be equal or unequal.

According to the second arrangement (which may supplement the first or be supplemented by it), said opposing slot edges delimit a radial slot, the general direction of said radial slot being at least approximately parallel to said axis of the casing.

It will be noted that:

the U.S. Pat. No. 3,176,303 already describes an antenna reflector comprising a rigid central base, from which a plurality of petals, in the form of sectors, extend radially, constituting the reflector of the antenna, each of said petals being produced from an elastically deformable rigid material, in order to be able to take up either a bent position under stress, which corresponds to the folded storage position of said reflector, or a position spontaneously deployed in the form of a concave disk, which corresponds to the deployed operating position of said reflector, the change from the folded position to the deployed position being due solely to the elastic relaxation of said petals, previously elastically bent. In the folded position, the opposing edges of adjacent petals overlap in pairs, and controllable retaining means, of the peripheral belt type, are provided to keep said petals together in the folded position of the reflector.

In such a known antenna reflector, the number of petals is very high, such that, in the folded position, said reflector exhibits the shape of a tulip, which prevents it being arranged laterally with respect to the body of the spacecraft, in the peripheral space defined between said body and said casing and of laterally enveloping said body.

Hence the U.S. Pat. No. 3,176,303 is completely foreign to the technical problems of longitudinal size and of vibration, which are solved by the present invention;

the U.S. Pat. No. 5,574,472 and the patent EP-A-0 534 110 describe an antenna reflector in a single piece of an elastically deformable material, which can take up a folded position in the form of a bowl by virtue of a controllable-breaking tension link arranged between two diametrally opposed points on the periphery on said reflector. It will be noted that, in this bowl-shaped folded position, the upper peripheral edge of the reflector, protruding with respect to the body of the spacecraft, is straightened outwards and cannot therefore be accommodated in the conical part of the casing.

Hence it will be noted that these latter two patents cannot suggest the present invention. Moreover, it will be noted that said tension link constitutes an obstacle, or at the very least an impediment, for arranging the body of the spacecraft in the concavity of the reflector in the folded position, and that the production of said reflector in a single piece allows neither precise control of the shape of the reflector in the folded position, nor optimal enveloping of the body of the spacecraft.

By comparison with the prior art reviewed above, it is thus seen that:

the first special feature of the present invention consisting in producing said elastically deformable reflector in a limited number of parts which can be partially superposed along their opposing edges makes it possible:

to increase the dimensions of said reflector;

to increase the accommodation capacity of said casing;

better to control the shape of the reflector in the folded position, by concentrating the major part of the elastic deformation in limited areas;

the second special feature of the present invention consisting in fixing said reflector in the folded position on the body of said spacecraft makes it possible:

better to control the vibration of said reflector in the folded position;

better to control the shape of said reflector in the folded position;

to use retaining mechanisms known for other uses.

In the reflector in accordance with the present invention, said controllable retaining means may secure said opposing edges together and fix them onto the body of said spacecraft. They may, in a variant, secure the reflector parts independently of one another onto the body of said spacecraft.

It will be noted that, in the case in which the two arrangements of slot edges mentioned above are combined, the possibility of tightening said reflector about the body of said spacecraft is enhanced, with the spacecraft being better enveloped. It is then advantageous to provide floating controllable retaining means in order to keep the edges of said radial slot together, in an overlapping position.

Moreover, in order to maintain the relative positions of said reflector parts in the deployed position of the reflector, linking means are provided allowing relative movement of said edges in the folded position of said reflector, but linking said parts together when said reflector is in the deployed position. In the case of edges which are capable of overlapping, such linking means may comprise self-rigid tapes, which however are flexible in compression, arranged transversely to said slots and anchored to said reflector, on either side of the slots. In the case of edges which are capable of being spaced apart, such linking means may include at least one tension spring.

The Figures of the attached drawing will give a good understanding of how the invention can be produced. In these Figures, identical references designate similar elements.

DESCRIPTION OF THE PREFERRED EMBODIMENTS

Figure 2:
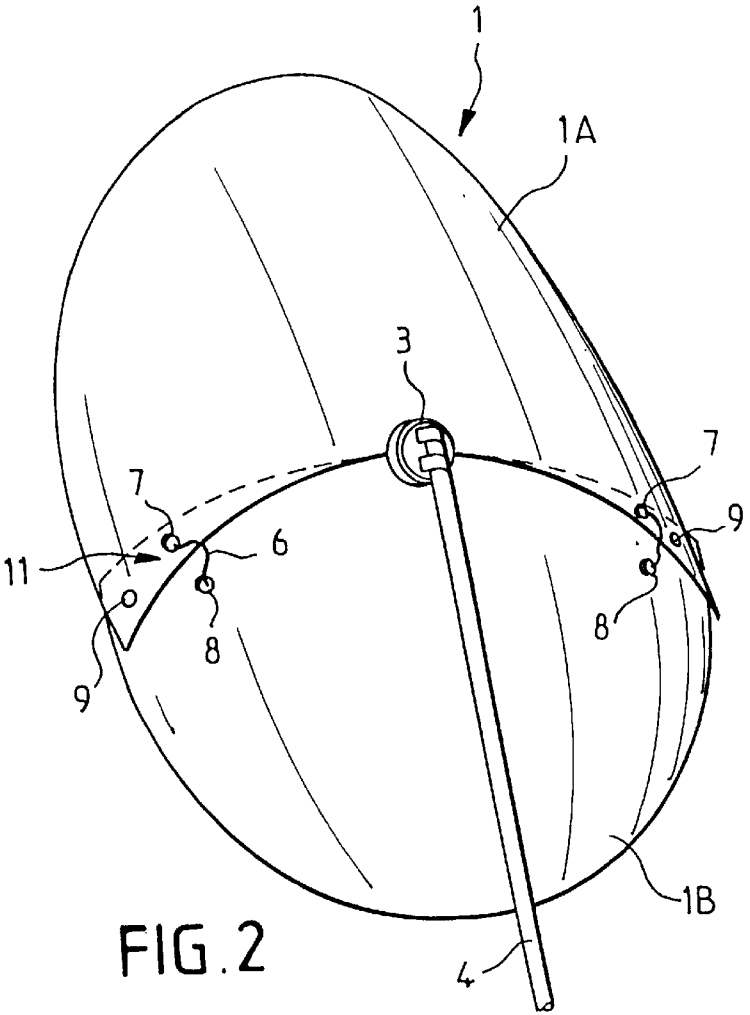
FIG. 2 is a view in diagrammatic perspective, from the rear, of the embodiment of the antenna reflector of FIG. 1, in the folded position.
Figure 1:
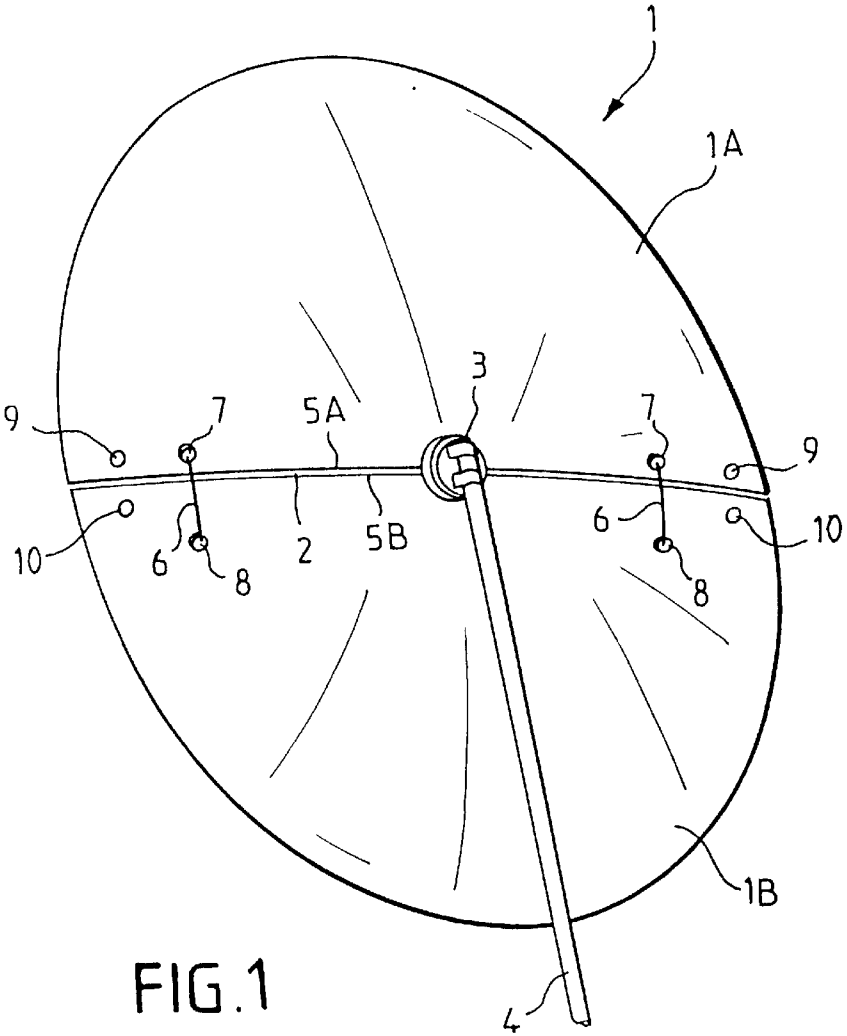
FIG. 1 is a view in diagrammatic perspective, from the rear, of an embodiment of the antenna reflector in accordance with the present invention, in the deployed position.

The antenna reflector 1, in accordance with the present invention and illustrated diagrammatically in FIGS. 1 and 2, exhibits the shape, at least approximately, of a concave disk and is formed of two halves 1A and 1B, separated from one another by a diametral slot 2 crossing said disk from one edge to the other. At the center of the reflector 1 a rigid base 3 is provided, linked on the rear side—that is to say on the convex side of said reflector—to a linking arm 4, the end of which remote from said base 3 is intended to be articulated, in a known way which is not represented, to the body of a spacecraft. In the example represented in FIG. 1, the linking arm 4 is orthogonal to said diametral slot 2, when the reflector 1 is deployed.

Each half 1A and 1B of the reflector 1 is produced from an elastically deformable material, for example from a carbon fiber fabric. If appropriate, stiffening rings (not represented) are arranged on the convex rear face of said reflector 1.

In the deployed position of the reflector (FIG. 1), the diametral slot 2 is delimited by edges 5A, 5B respectively, and the relative positions of said edges 5A and 5B are maintained by flexible ties 6 transverse to said slot.

Figure 3A:
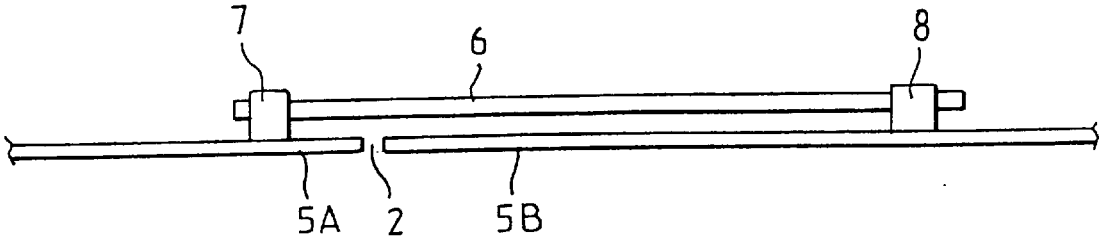
FIGS. 3A and 3B, in views corresponding respectively to FIGS. 1 and 2, illustrate a flexible linking device preventing relative movement of the reflector halves in the deployed position.

As FIG. 3A shows in more detail, each tie 6, which consists for example of a flexible elastic strip of curved cross-section in the manner of the tape of a measuring tape, is anchored at its ends, respectively to the half of the reflector 1A by a stud 7 and to the half of the reflector 1B by a stud 8.

Moreover, on either side of the slot 2, eyelets 9 and 10 are provided in the halves of the reflector 1A and 1B, respectively.

Figure 3B:
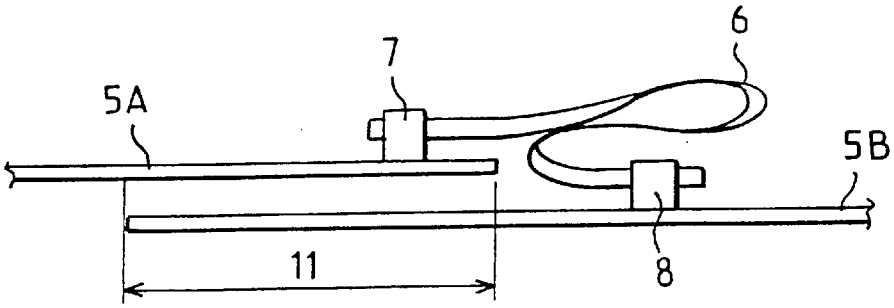

Hence, as FIGS. 2 and 3B show, the reflector 1 can take up a position folded about the base 3 with discontinuity of curvature, for which the edges 5A and 5B overlap in an overlapping region 11, which widens out from the center towards the periphery of said reflector. In this folded position, the ties 6 are relaxed and the eyelets 9 and 10 are superposed.

Figure 4:
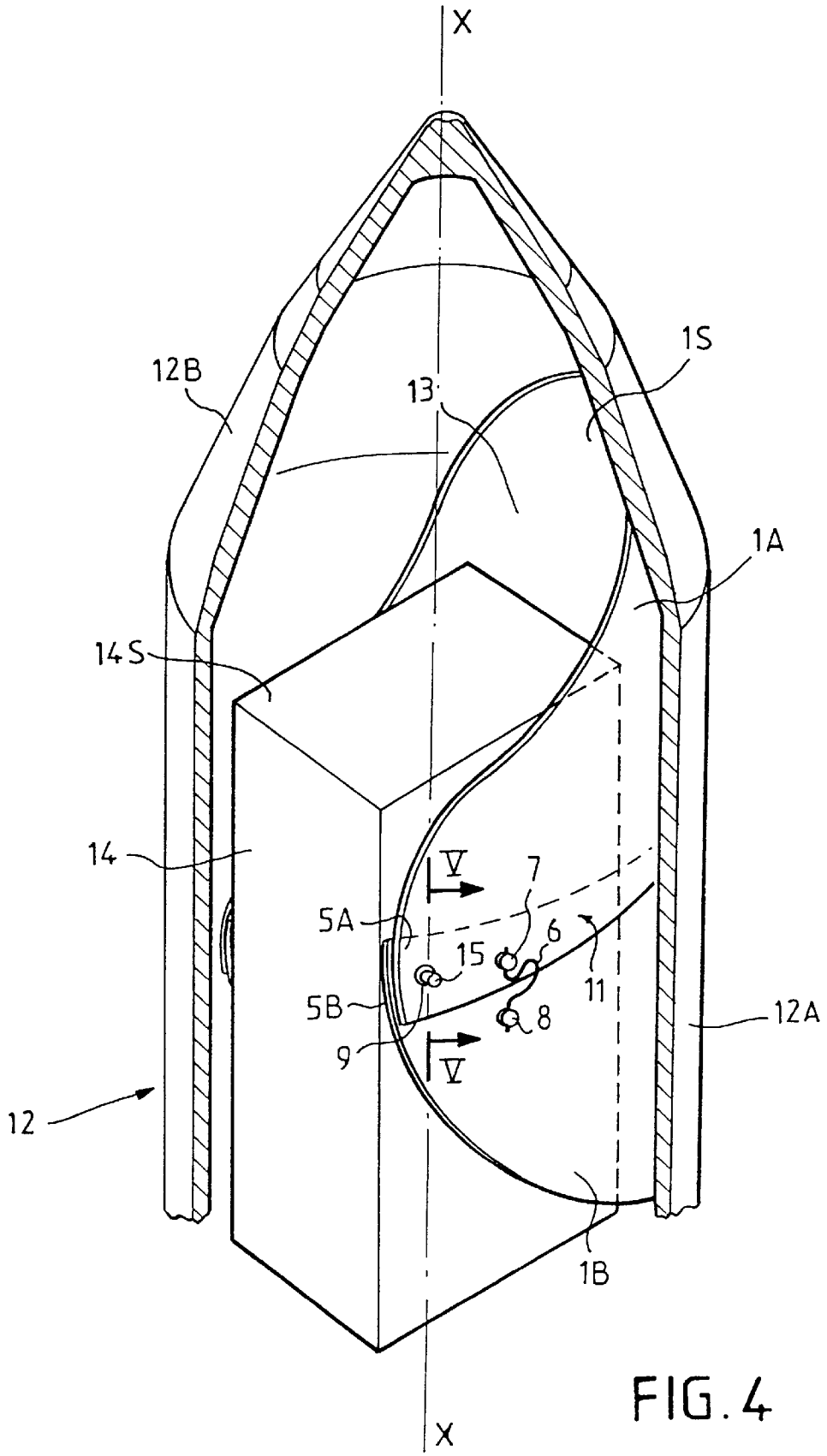
FIG. 4 diagrammatically shows the reflector in accordance with FIGS. 1 and 2 arranged around a satellite, under the nose cone of a launcher.

As FIG. 4 diagrammatically illustrates, the reflector 1 can be stored in an elongate casing 12 with longitudinal axis X—X, for example the nose cone of a space launcher including a cylindrical part 12A surmounted by a conical part 12B, the reflector 1 being arranged in the peripheral lateral space 13 delimited between the body 14 of a satellite and the cylindrical part 12A of said casing 12. As is usual (not visible in FIG. 4), the reflector 1 is linked to the satellite body 14 by the arm 4, which is articulated to the lower part of said body.

In this storage position, the edges 5A and 5B of said reflector halves 1A and 1B overlap (region 11) and said reflector halves are moreover elastically folded about the axis X—X orthogonal to the slot 2, so as to envelop the body 14.

By virtue of the breaking of the reflector about the slot 2, it is seen that the upper part 1S of said reflector 1, protruding by comparison with the satellite body 14, is brought towards the center of the casing 12 and the upper face 14S of said body, and can thus be housed in the conical part 12B of the casing.

Figure 5A:
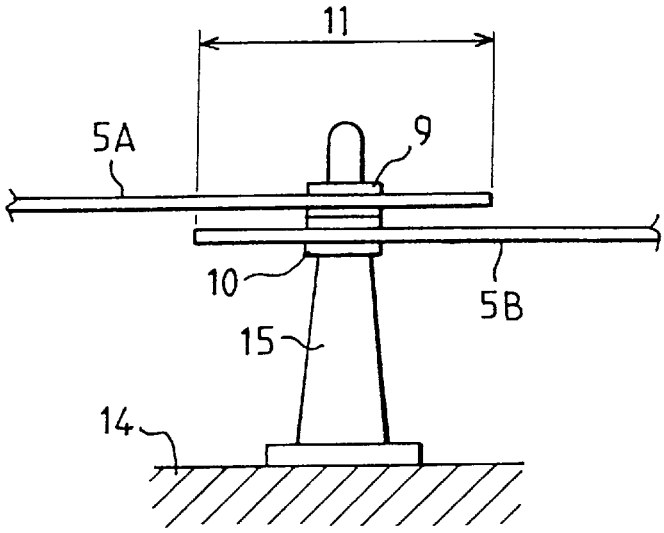
FIGS. 5A and 5B illustrate, in its locked and unlocked positions respectively, a device for retaining said reflector of FIG. 4 on the body of said satellite, along the line V—V of this latter Figure.

In the storage position of FIG. 4, the reflector 1 is, moreover, held by pyrotechnic studs 15 passing through the opposing eyelets 9 and 10 of the reflector halves 1A and 1B (see FIG. 5A) and integral with the body 14 of the satellite.

Figure 5B:
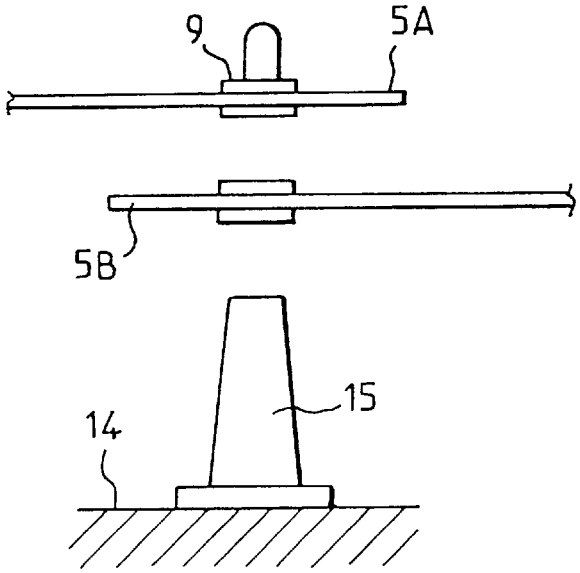

Hence, during the launch of the satellite 14, the reflector is in the nose cone 12, as represented in FIG. 4, held rigidly in its folded shape. After said nose cone 12 is jettisoned, and the satellite 14 is ejected, the pyrotechnic studs 15 are activated and they release the reflector halves 1A and 1B from the body of the satellite 14 (see FIG. 5B). Next, under the action of its own elasticity, the reflector 1 relaxes so as to spontaneously to take up its deployed state of FIG. 1, the arm 4 tilting (in a known way which is not represented) so as to free said reflector from the body of the satellite 14.

Figure 7:
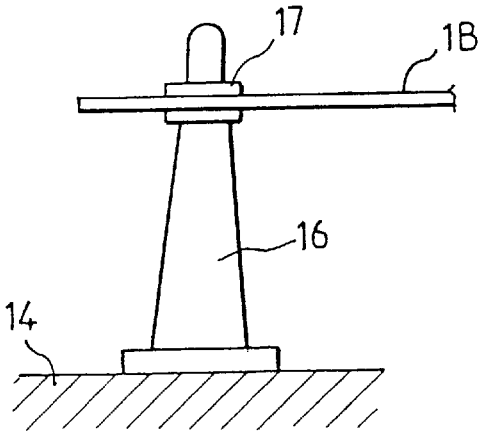
FIG. 7 shows, in the locked position, a device for retaining the reflector of FIG. 6 on the body of said satellite, along the line VII—VII of this latter Figure.
Figure 6:
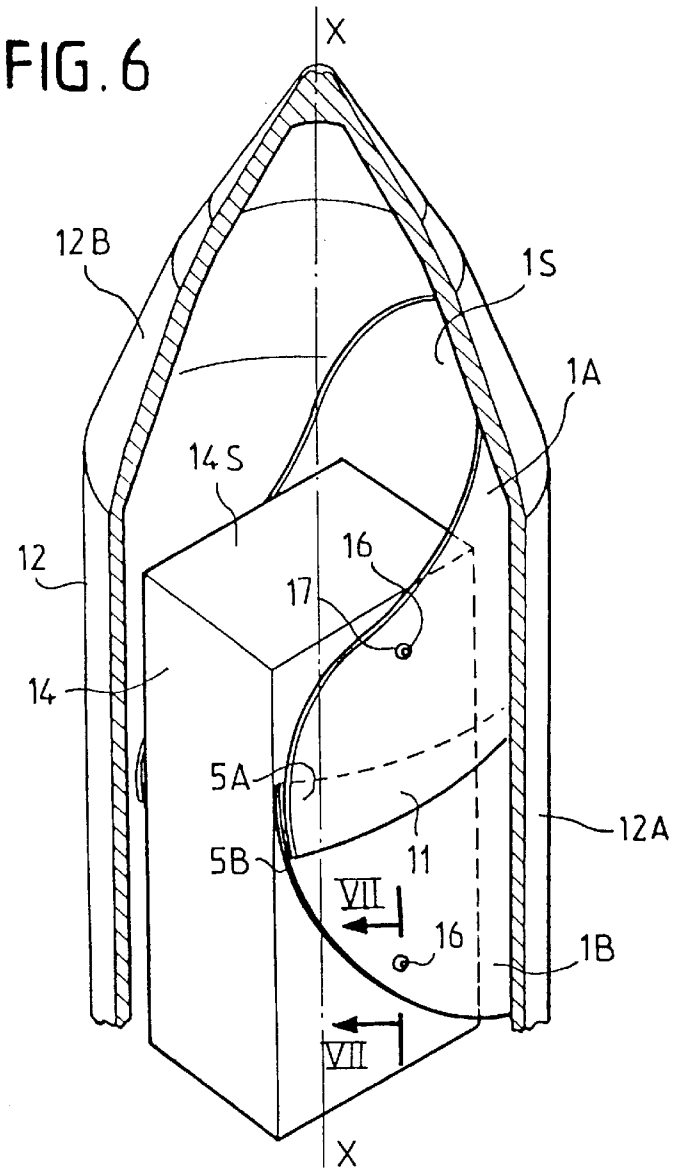
FIG. 6, in a view similar to that of FIG. 4, shows a variant arrangement of the reflector under the nose cone of the launcher.

In FIG. 6, a variant for holding the reflector 1 in the folded position has been represented. In this case (see also FIG. 7), the reflector halves 1A and 1B are held integral with the body of the satellite 14 by individual pyrotechnic studs 16 which are integral with the body and pass through eyelets 17. The individual pyrotechnic studs 16 are then outside the overlap region 11.

Figure 8:
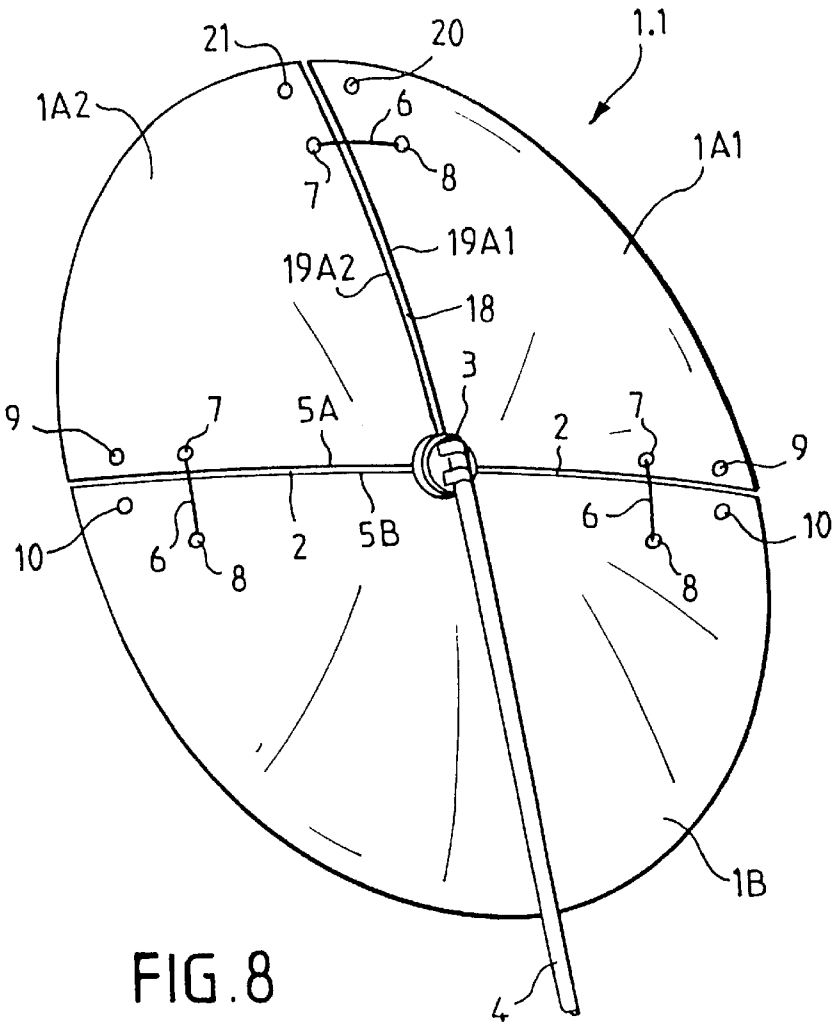
FIG. 8, in a view similar to FIG. 1, shows a variant embodiment of the antenna reflector in accordance with the present invention, in the deployed position.

FIG. 8 shows a variant embodiment 1.1 of the reflector 1 in accordance with the present invention, which is capable of fitting even better into the conical part 12B of the nose cone 12. In this variant, the reflector half 1A is itself separated into two separate parts 1A1 and 1A2 by a radial slot 18, along opposing edges 19A1 and 19A2 capable of overlapping in the manner of the edges 5A and 5B. In the folded position, this embodiment variant can thus even further envelop the body of the satellite 14.

Figure 9:
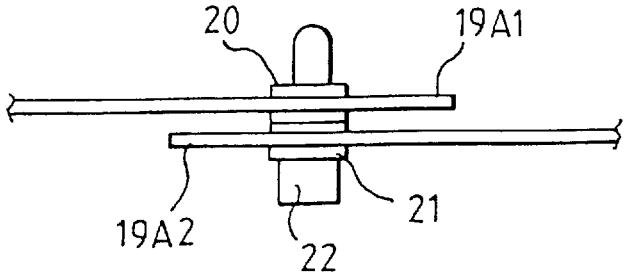
FIG. 9 shows a flying retaining device for the antenna reflector of FIG. 8.

Linking means 6, 7, 8 are also provided for holding the edges 19B1 and 19B2 in position. Moreover, said parts 1A1 and 1A2 include respective eyelets 20 and 21 coming opposite one another when said edges 19A1 and 19A2 overlap (see FIG. 9) so as to be able to be traversed by a pyrotechnic stud 22. The pyrotechnic stud 22 may be floating, that is to say not linked to the body of the satellite 14.

Clearly, the pyrotechnic stud 22 is also activated when the reflector 1 of FIG. 8 is deployed.

Figure 10:
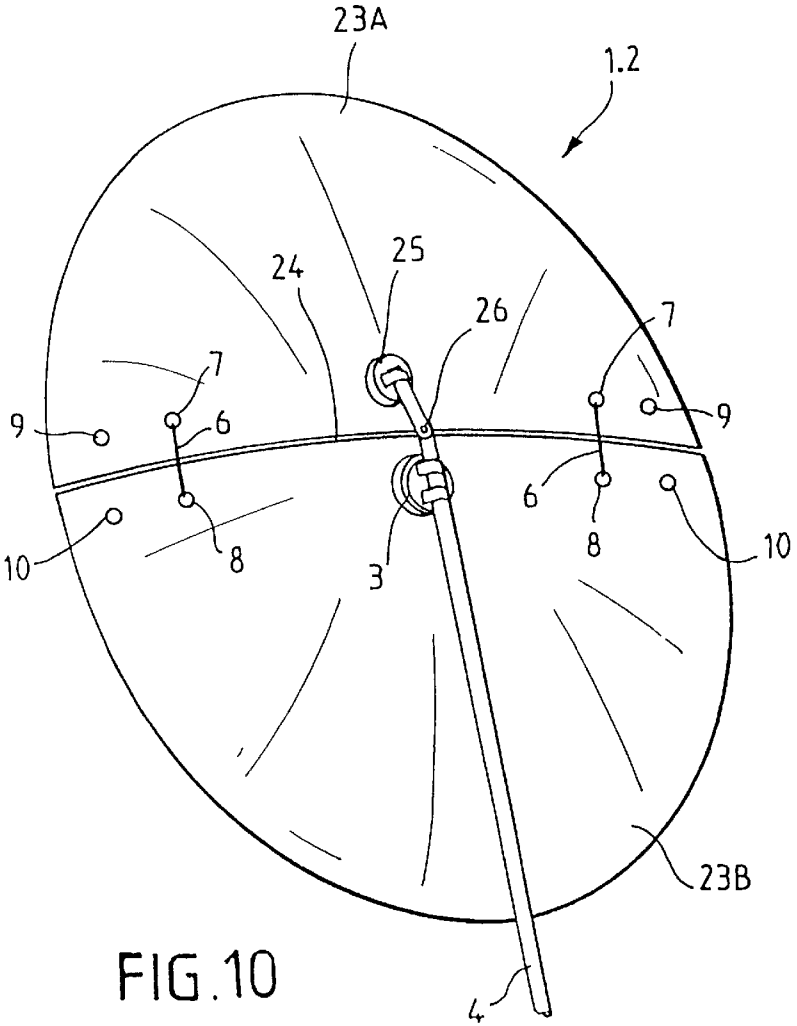

In the variant embodiment 1.2 shown diagrammatically by FIG. 10, the concave disk of the reflector is formed by two unequal parts 23A and 23B, separated from one another by a non-diametral slot 24 crossing said disk from one edge to the other, off center with respect to said disk and arranged orthogonally to the axis X—X. The large part 23B is linked to the rigid base 3, which is itself carried by the arm 4. The small part 23A is provided with a rigid median base 25, linked to the rigid base 3 by an articulation 26. It can easily be envisaged that, by virtue of the slot 24 and of the articulation 26, the embodiment 1.2 can take up a folded position similar to that shown by FIGS. 2, 4 and 6 in the case of embodiment 1, the only difference here being that the slot 24 is not diametral and that the parts 23A and 23B are unequal.

Figure 11:
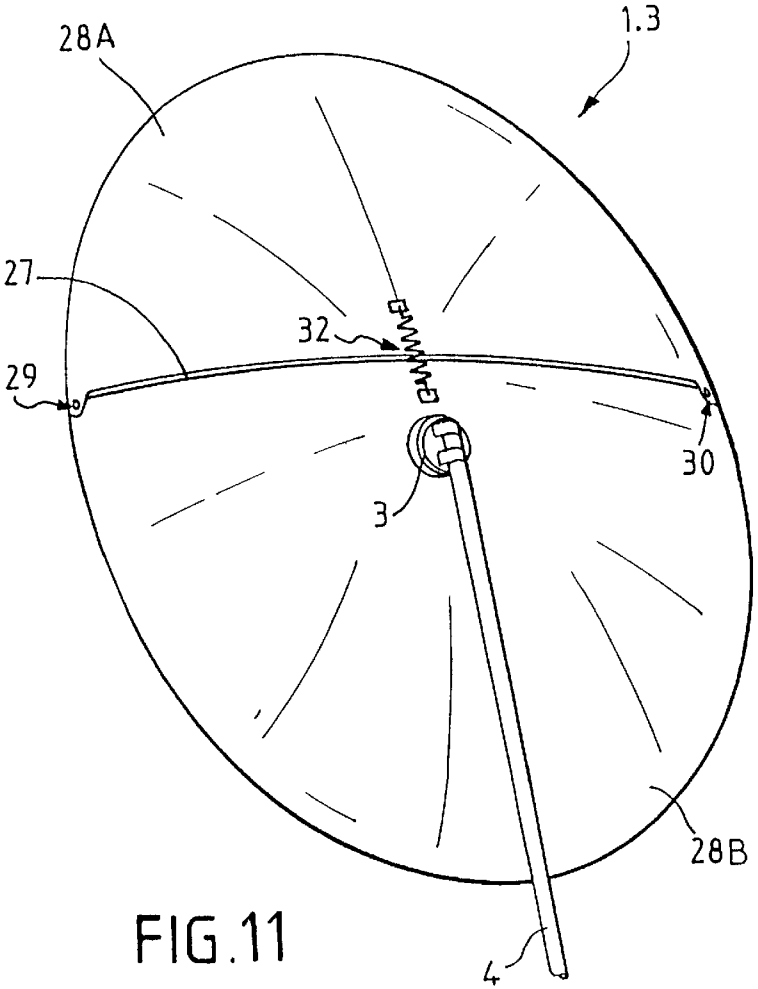
FIGS. 10 and 11 are diagrammatic views in perspective, from the rear, of embodiment variants of the antenna reflector in accordance with the present invention, in the deployed position.
Figure 12:
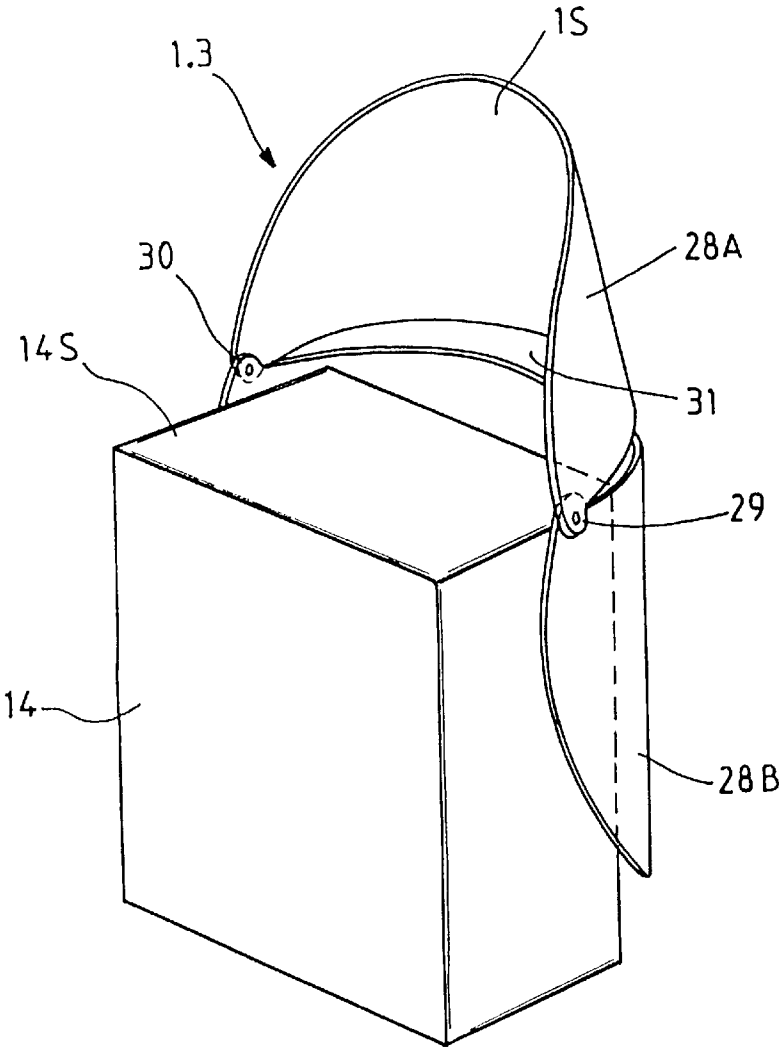
FIG. 12 is a diagrammatic view in perspective, from the front, of the variant embodiment of FIG. 11, in position enveloping a satellite.

In the variant embodiment 1.3 shown diagrammatically by FIGS. 11 and 12, just as in variant 1.2 of FIG. 10, a non-diametral slot 27 crossing the concave disk of the reflector from one edge to the other divides it into two unequal parts 28A and 28B, the larger of which is linked to the rigid base 3 and to the articulated arm 4. Said reflector parts 28A and 28B are linked to one another close to the periphery of said reflector by articulations 29, 30, so that the opposing edges of the slot 27 can move apart from one another (see reference 31 in FIG. 12) so as to bring the protruding peripheral part 1S of the reflector 1.3 back in the direction of the longitudinal end 14S of the body 14. A tension-spring device 32, the action of which opposes the opening of the slot 27, makes it possible to fix the parts 28A and 28B rigidly together in the deployed position.

Figure 13:
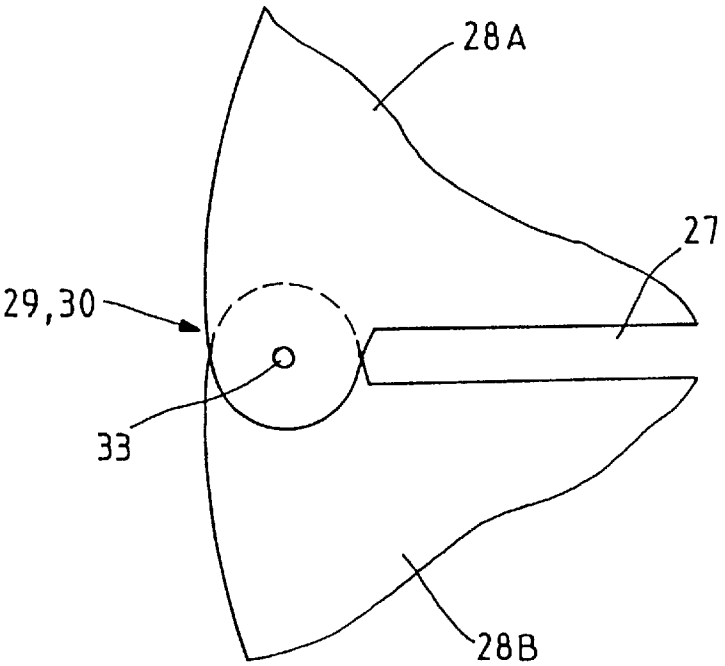
FIG. 13 illustrates an articulation of the peripheral edges of the two parts of the reflector of FIGS. 11 and 12.

As FIG. 13 shows, each of the peripheral articulations 29, 30 can be formed by a clevis provided with a rotation pin 33.

Although only one single reflector 1, 1.1, 1.2 or 1.3 associated with the body of the satellite 14 has been mentioned above, it goes without saying that the present invention is not limited to such an embodiment. In fact, in the usual way, two such opposed reflectors can be combined jointly on said satellite body 14, as is illustrated, for example, in the U.S. Pat. No. 5,644,322. Corresponding pyrotechnic studs 15, 16, 22 are then provided.

What is claimed is:

1. An antenna reflector for a spacecraft for being stored in a casing of cylindrical-conical shape comprising a cylindrical part and a conical part, said reflector being elongate along an axis so that said reflector is arranged laterally with respect to a body of said spacecraft, in a peripheral space defined between said body and the cylindrical part of said casing, said reflector comprising a protruding peripheral part projecting longitudinally into the conical part of said casing from a longitudinal end of said body, said reflector being at least partly elastically deformable so that when residing outside said casing, said reflector assumes a stable, deployed position without elastic stress, corresponding to its functional shape, and when stored within said casing, said reflector folds around said axis of the casing to assume a folded position allowing it laterally to envelop said body, said reflector being retained in the folded position by a controllable retaining means; and a change by said reflector from the folded position to the deployed position occurring at least in part from a release of energy stored in said reflector from changing a position of said reflector from the deployed position to the folded position, wherein:

said reflector is separated into two parts by first opposing slot edges; and in the folded position of said reflector, said first opposing edges of the two parts of said reflector move with respect to one another so as to bring said protruding peripheral part of the reflector closer to said longitudinal end of said body.

2. An antenna reflector as claimed in claim 1, wherein said first opposing slot edges delimit a crossing slot which crosses said reflector from one edge to the other, and wherein the general direction of said crossing slot is at least approximately orthogonal to said axis of the casing.

3. An antenna reflector as claimed in claim 2, wherein at least one of said two parts delimited in the reflector by said crossing slot includes at least one radial slot which further separates the one of said two parts into two separate parts, along second opposing edges, capable of overlapping.

4. An antenna reflector as claimed in claim 2, wherein said two parts of said reflector are linked to one another near a middle of said crossing slot, and wherein said first opposing edges of said two parts of said reflector overlap so as to bring said protruding peripheral part of the reflector closer to said longitudinal end of said body.

5. An antenna reflector as claimed in claim 4, wherein said crossing slot is diametral, such that said two parts of said reflector each comprises a half of said reflector, and wherein said reflector halves are integral with one another near a center of said reflector.

6. An antenna reflector as claimed in claim 4, wherein said crossing slot is arranged off-center with respect to said reflector, such that said two parts of said reflector are unequal, and wherein said two parts of said reflector are linked to one another by an articulation means.

7. An antenna reflector as claimed in claim 2, wherein said two parts of said reflector are linked to one another near the periphery of said reflector, and wherein said first opposing edges of said two parts of said reflector move apart from one another in order to bring said protruding peripheral part of the reflector closer to said longitudinal end of said body.

8. An antenna reflector as claimed in claim 7, wherein said two parts of said reflector are linked to one another by peripheral articulations arranged at end portions of said crossing slot.

9. An antenna reflector as claimed in claim 1, wherein at least one of said two parts of said reflector is further separated by second opposing slot edges which delimit a radial slot, and wherein the general direction of said radial slot is at least approximately parallel to said axis of the casing.

10. An antenna reflector as claimed in claim 9, wherein said controllable retaining means includes means for floating it with respect to the body of said spacecraft, in order to retain said second opposing edges of said radial slot together, in an overlapping position.

11. An antenna reflector as claimed in claim 1, wherein said controllable retaining means retain said first opposing edges of said reflector together and fix said first opposing edges onto the body of said spacecraft.

12. An antenna reflector as claimed in claim 1, wherein said controllable retaining means secure said two parts of said reflector independently of one another onto the body of said spacecraft.

13. An antenna reflector as claimed in claim 1, which includes linking means for allowing relative movement of said first opposing edges and second opposing edges of said two parts of said reflector in the folded position and for linking said two parts of said reflector together when said reflector is in the deployed position.

14. An antenna reflector as claimed in claim 13, wherein each of said linking means includes a self-rigid tape which is flexible in compression, is arranged transversely to one of said crossing slot and said radial slot, and is anchored to said reflector, on either side of the one of said crossing slot and said radial slot.

15. An antenna reflector as claimed in claim 13, wherein each of said linking means includes at least one tension spring.

* * * * *